US007390951B2

(12) United States Patent
Dulaney et al.

(10) Patent No.: US 7,390,951 B2
(45) Date of Patent: Jun. 24, 2008

(54) UNIVERSAL TUNER MOUNT

(76) Inventors: James R Dulaney, 13774 Gazebo La., Apt. 422, Euless, TX (US) 76040; Andrew P Nelson, 4174 Wilada Dr., Dallas, TX (US) 75220; Robert H Palmer, 8408 Lancome Dr., Plano, TX (US) 75025; Mark L Wilson, 3331 Kiest Forest Dr., Dallas, TX (US) 75233

( * ) Notice: Subject to any disclaimer, the term of this patent is extended or adjusted under 35 U.S.C. 154(b) by 0 days.

(21) Appl. No.: 10/604,317

(22) Filed: Jul. 10, 2003

(65) Prior Publication Data

US 2005/0005759 A1 Jan. 13, 2005

(51) Int. Cl.
*G10G 7/02* (2006.01)

(52) U.S. Cl. ..... 84/454

(58) Field of Classification Search ..... 84/454, 84/394, 453, 421, 327, 329
See application file for complete search history.

(56) References Cited

U.S. PATENT DOCUMENTS 892,105 A * 6/1908 White ..... 248/60
3,576,149 A * 4/1971 Slingerland, Jr. ..... 84/421
4,734,001 A * 3/1988 Bennett ..... 411/119
5,637,820 A 6/1997 Wittman
5,728,959 A 3/1998 O'Rorke
5,973,248 A * 10/1999 Chen ..... 84/421
5,990,403 A 11/1999 Membreno et al.
6,491,014 B1 * 12/2002 Eickert ..... 123/195 C
6,815,589 B2 * 11/2004 Liao ..... 84/327

OTHER PUBLICATIONS

US D402,864, 12/1998, Wilson et al. (withdrawn)

* cited by examiner

*Primary Examiner*—Kimberly Lockett
(74) *Attorney, Agent, or Firm*—Daniel V. Thompson

(57) ABSTRACT

A universal mount for acoustically coupling a musical instrument tuner to an instrument has a link connected to the tuner at one end, the link adapted and arranged to have selectable loose and fixed states, with the link including complementary first and second clamping halves joined by a compression element, and a clamp connected to the other end of the link for acoustically coupling the tuner to the musical instrument.

28 Claims, 4 Drawing Sheets

UNIVERSAL TUNER MOUNT

BACKGROUND OF INVENTION

Electro-mechanical musical instrument tuners have been provided for acoustically coupling to musical instruments for sensing mechanical vibrations of the musical instruments to determine the pitch of tones being emitted by the musical instruments. The detected pitch is then used to provide an output indicating the pitch of the tone being played. These musical instrument tuners can be used both for tuning the musical instruments and for developing a player's ear for detecting the pitch being played, such as for teaching a person to recognize various intonations.

In the past, musical instrument tuners have been clamped directly to the instruments using C-type clamps to acoustically couple the tuners to the instruments, such that mechanical vibrations will pass to a vibratory motion detector mounted within the housing of the tuner. One type of C-type clamp is found in the Intellitouch™ PT1™ tuner offered by Onboard Research Corp. of Carrollton, Tex., which was the subject of U.S. Design Pat. No. D402,684. This tuner has two opposed, parallel, planar pads that are urged into contact with the instrument and then locked with clamping pressure sufficient to hold the tuner on the instrument. While this tuner has been an outstanding success, a limitation of this device is that the simple, planar clamping pads are not well-adapted for attachment to round surfaces, such as brass horn pipes, violin necks, etc. In addition, this tuner is difficult to attach to brass or woodwind bells, due to the curved shapes and reinforced bell rims. Other C-type clamps typically have a threaded clamping member which is subject to over tightening of the threaded coupling, which may cause damage to the musical instruments from excessive forces being applied to the instrument. In addition, alligator clips have also been used to clip musical instrument tuners to instruments, which may result in teeth of the alligator clips placing scratch marks on the exterior of the instruments.

U.S. Pat. No. 5,990,403 issued to Membreno, et al., is directed to a tuner that has a special adapter for fixing the tuner to an instrument lyre commonly used with wind instruments. This attachment technique, while exceptionally effective for those type of instruments, is not useful with other instruments lacking such a lyre.

Past tuners have also been limited in the directions from they may be viewed when attached to the few attachment locations available. The PT1™ tuner mentioned above has a simple one-axis pivoting connection between the tuner and the clamp, which is usable in most applications, but greater freedom of relative positioning between the clamp and the tuner would yield a greater number of satisfactory uses.

Thus a need presently exists for a tuner mount that permits an increased number of attachment locations and enhanced positionability with respect to the user once attached.

SUMMARY OF INVENTION

A universal mount for acoustically coupling a musical instrument tuner to an instrument has a link connected to the tuner at one end, the link adapted and arranged to have selectable loose and fixed states, with the link including complementary first and second clamping halves joined by a compression element, and a clamp connected to the other end of the link for acoustically attaching the tuner and link to the musical instrument.

BRIEF DESCRIPTION OF DRAWINGS

A more complete understanding of the invention and its advantages will be apparent from a review of the Detailed Description in conjunction with the following Drawings, in which.

DETAILED DESCRIPTION

Figure 1:
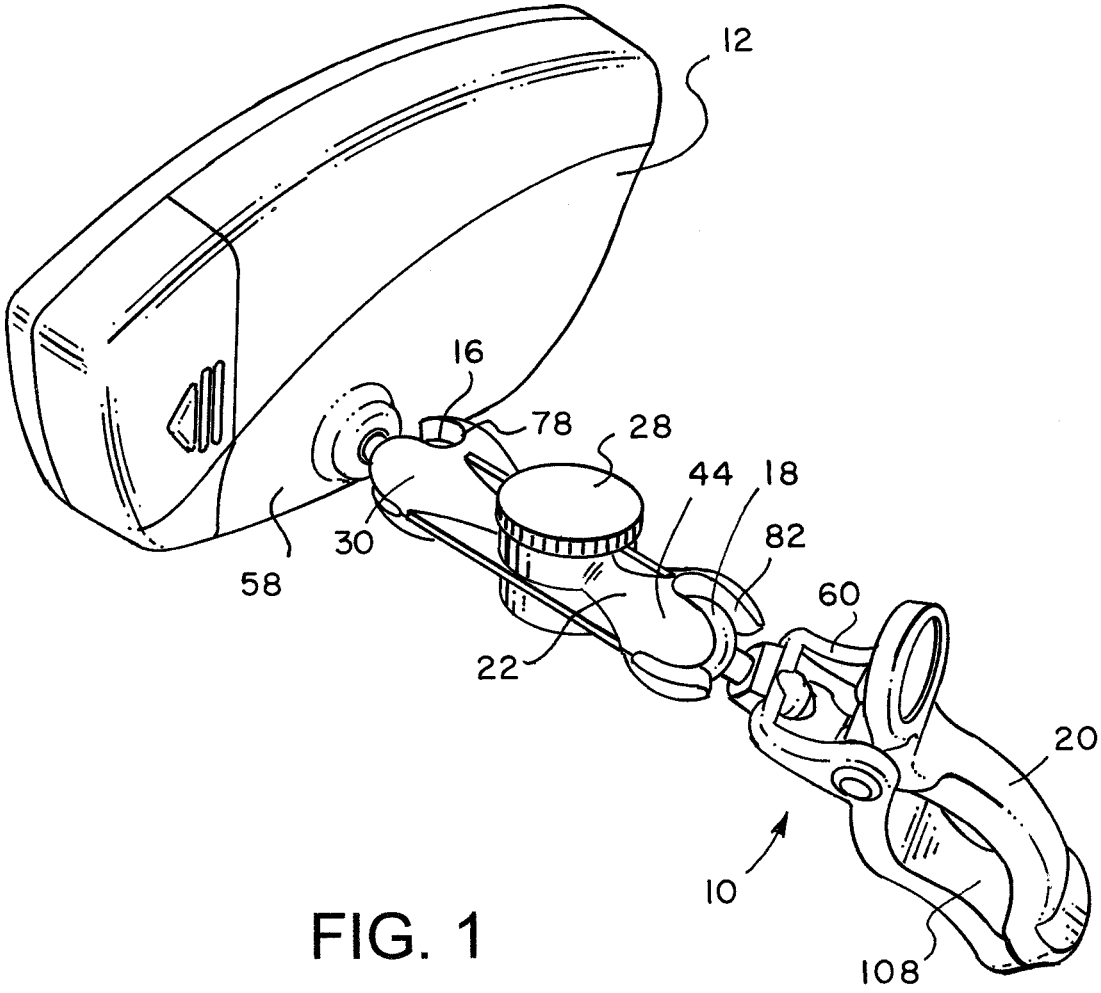
FIG. 1 is a perspective view of the apparatus of the present invention.
Figure 2:
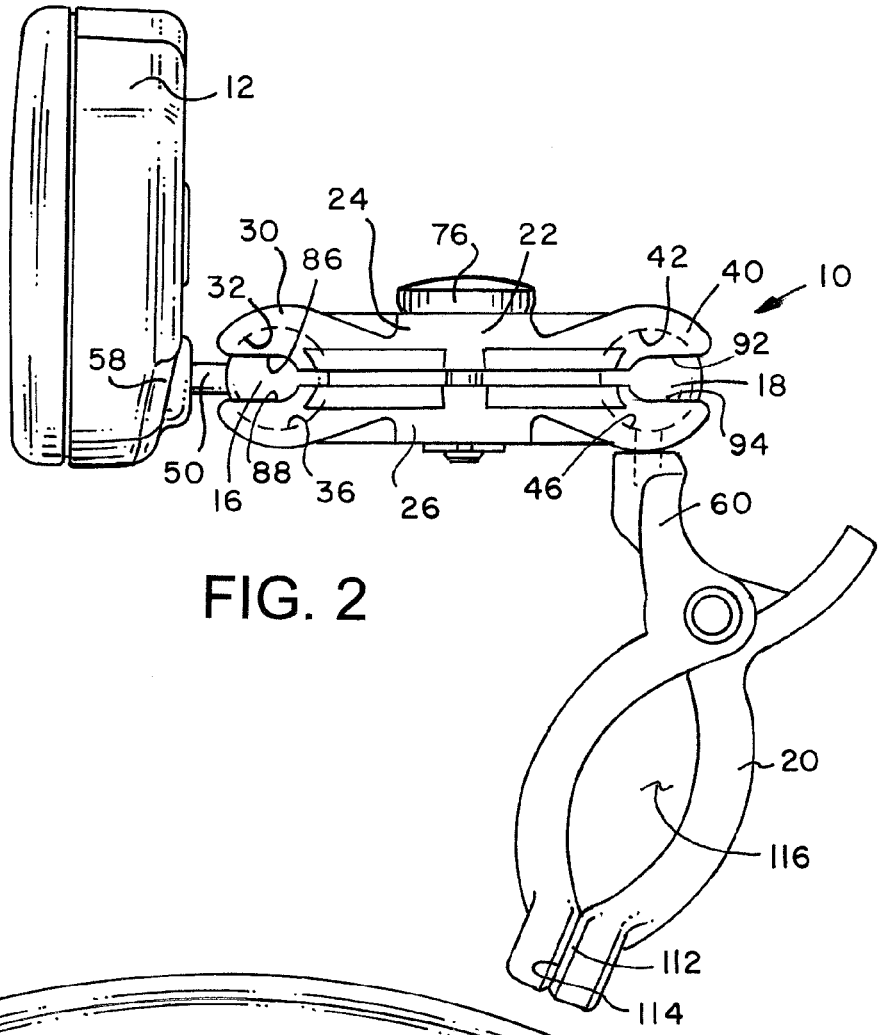
FIG. 2 is a side view.
Figure 3:
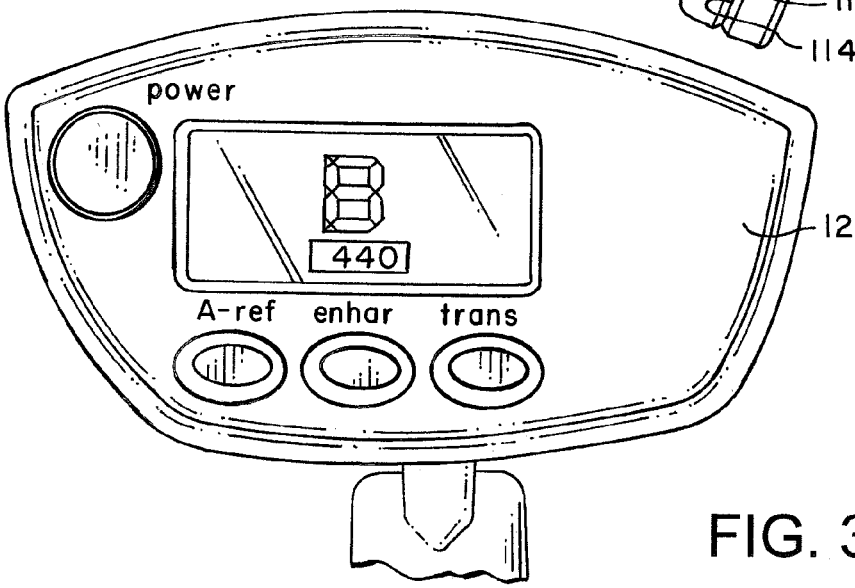
FIG. 3 is an end view of the tuner.
Figure 4:
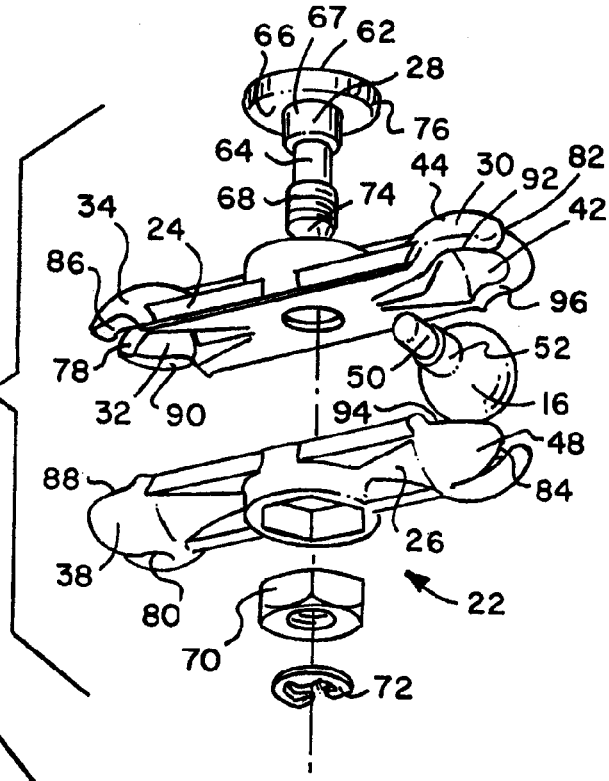
FIG. 4 is an exploded view of a link usable with the invention.
Figure 5:
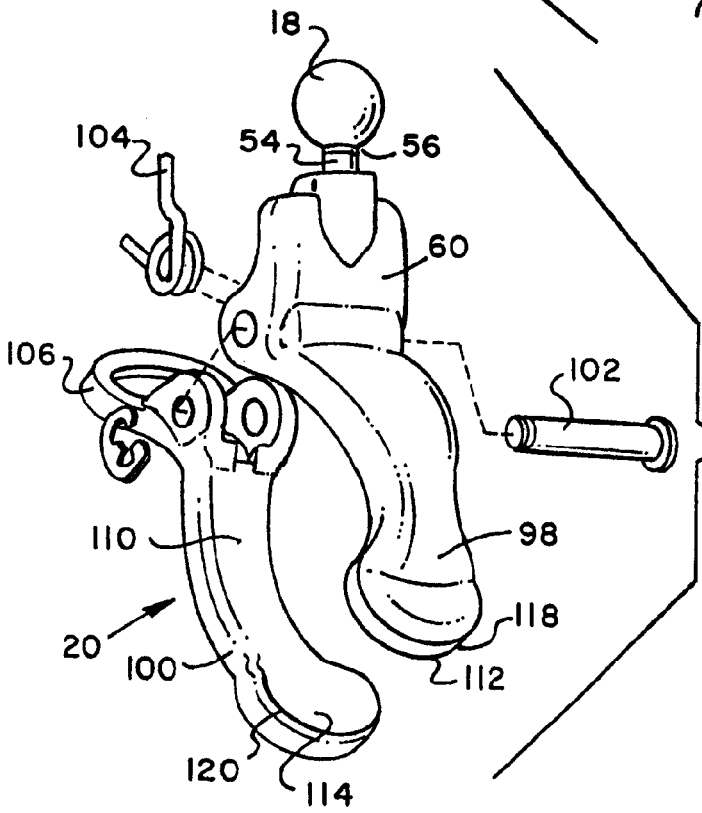
FIG. 5 is an exploded view of a clamp usable with the invention.
Figure 6:
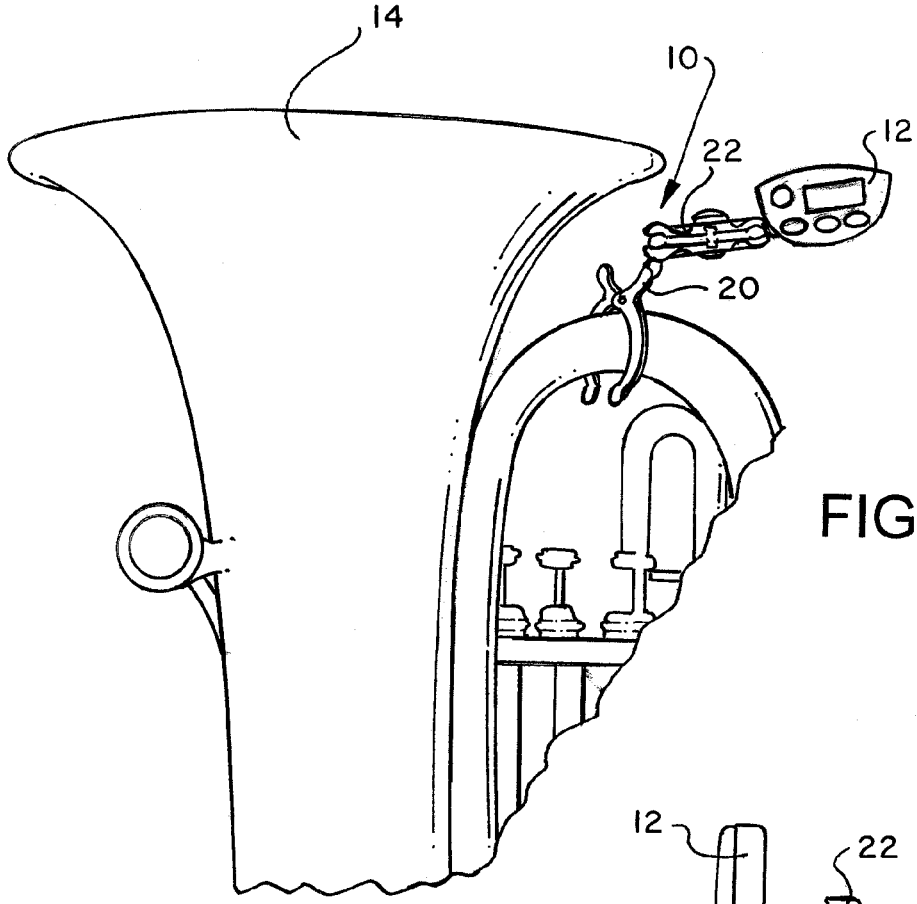
FIG. 6 is a side view of the invention in use on a first musical instrument.

Referring initially to FIGS. 1-7, where like numerals indicate like and corresponding elements, a universal mount 10 is provided for acoustically coupling tuner 12 to a musical instrument 14.

A tuner sphere 16 with a center point is fixed to the tuner 12. A similarly-sized clamp sphere 18 with a center point is fixed to a clamp 20, the clamp 20 being for acoustically coupling the tuner 12 to the musical instrument 14. A link 22 is adapted and arranged to have selectable loose and fixed states, with the link including complementary first and second clamping halves 24,26 joined by a compression element 28.

Link

An opposing pair of curved surfaces is provided on a tuner end 30 of the link 22. One of said pair of curved surfaces, surface 32, is on a tuner end 34 of the first clamping half 24, and the other curved surface, surface 36, is on a tuner end 38 of the second clamping half 26.

Similarly, an opposing pair of curved surfaces is provided on the clamp end 40 of the link. One of said pair of curved surfaces, surface 42, is on a clamp end 44 of the first clamping half 24, and the other curved surface, surface 46, is on a clamp end 48 of the second clamping half 26.

The curved surfaces 32,36 at the tuner end are disposed to grip the tuner sphere 16 under compression imposed by the compression element 28 when the link 22 is in the fixed state and to release the tuner sphere 16 for relative swiveling motion about the center point of the tuner sphere 16 when the link 22 is in the loose state. Similarly, the curved surfaces 42,46 at the clamp end are disposed to grip the clamp sphere 18 under compression imposed by the compression element 28 when the link 22 is in the fixed state and to release the clamp sphere 18 for relative swiveling motion about the center point of the clamp sphere 18 when the link 22 is in the loose state.

Tuner post 50 extends from the tuner 12, and the tuner sphere 16 is connected to an end 52 of the tuner post 50 remote from the tuner 12. Similarly, a clamp post 54 extends from the clamp 20, and the clamp sphere 18 is connected to an end 56 of the clamp post 54 remote from the clamp 20. The tuner post 50 extends from a lower back surface 58 of the tuner 12, and the clamp post 54 extends from an actuating arm 60 of the clamp 20. Equivalent connection locations for the tuner post 50 on tuner 12 are possible.

In one embodiment of the invention, the compression element 28 includes a threaded fastener 62 extending through the clamping halves 24,26. Equivalent compression means are possible. Threaded fastener 62 includes a shaft 64 with an abutment surface 66 at one end 67 adjacent one clamping half 24 of the link. Fastener 62 has a male-threaded central section 68, and a female-threaded nut 70 is engaged with the central section 68 of the shaft 64. Nut 70 is adjacent the other clamping half 26 of the link 22, with the nut 70 fixed against rotation relative the other clamping half 26. An E-clip 72 is engaged with the other end 74 of the shaft 64, such that the E-Clip 72 prevents the shaft 64 and nut 70 from being be completely disengaged. The fixed state of the link 22 is selected by turning the shaft 64 relative the nut 70 in one direction to bring the abutment surface 66 and nut 70 into contact with their respective clamping halves 24,26, and the loose state of the link 22 is selected by turning the shaft 64 relative the nut 70 in the other direction. Compression element 28 in this embodiment is hand-operable by way of a knurled knob 76. Compression element 28 is centrally located between said tuner and clamp ends 30,40 of the link 22, to provide substantially equal clamping pressure on the tuner and clamp spheres 16,18.

A first slot 78 in the tuner end first clamping half curved surface 32 and a second slot 80 in the tuner end second clamping half curved surface 36 are provided. The first and second slots 78,80 at the tuner end permit lateral support of the tuner post 50 when the tuner post 50 is swivelled into engagement with any of the first or second slots 78,80 at the tuner end. Similarly, a first slot 82 in the clamp end first clamping half curved surface 42 and a second slot 84 in the clamp end second clamping half curved surface 46 permit lateral support of the clamp post 54.

Lateral support is also provided by opposed half slots 86,88,90 (the half slot opposite half slot 90 not shown) in the tuner end clamping half curved surfaces 32,36, which cooperate to form third and fourth slots at the tuner end.

The third and fourth slots at the tuner end permit lateral support of the tuner post 50 when the tuner post is swivelled into engagement with any of the third or fourth slots. Similarly, opposed half slots 92,94,96 (the half slot opposite half slot 96 not shown) in the clamp end clamping half curved surfaces 42,46 cooperate to form third and fourth slots at the clamp end.

Clamp

The clamp 20 has a pair of hinged, opposed clamping arms 98,100 joined by a pin 102 in scissors-fashion. The clamp 20 is urged to a closed state by a spring 104. The clamp 20 also has a pair of opposed actuating arms 60,106. Each of the actuating arms 60,106 extends from a different one of the clamping arms 98,100 at the hinge pin 102, such that relative motion of actuating arms 60,106 towards each other moves the clamp 20 to an opened state against the urging of the spring 104, and release of the actuating arms 60,106 causes the clamping arms 98,100 to clamp on to a part of a musical instrument 14 placed between the clamping arms 98,100.

Each of the clamping arms 98,100 includes a curved intermediate surface 108,110 and a planar end surface 112,114. The planar end surfaces 112,114 are parallel and abutting each other when the clamp 20 is in the closed state, and the curved intermediate surfaces 108,110 are oppositely curved, such that the curved intermediate surfaces 108,110 define an open space 116 between the curved intermediate surfaces 108,110. In one embodiment, curved intermediate surfaces 108,110 are partially cylindrical, and planar end surfaces 112,114 have semi-circular perimeters 118,120.

In operation, the mount of the present invention is usable in coupling a tuner to essentially every instrument known, with the tuner display positionable for comfortable, ready viewing. The clamp is designed to attach securely to: (1) brass and woodwind instrument pipes from 0.040 to 1.35 inches in diameter; (2) brass and woodwind bells of any size; and (3) stringed instrument's scrolls, headstocks, pegboxes, bridges, tailpieces and bodies.

Figure 7:
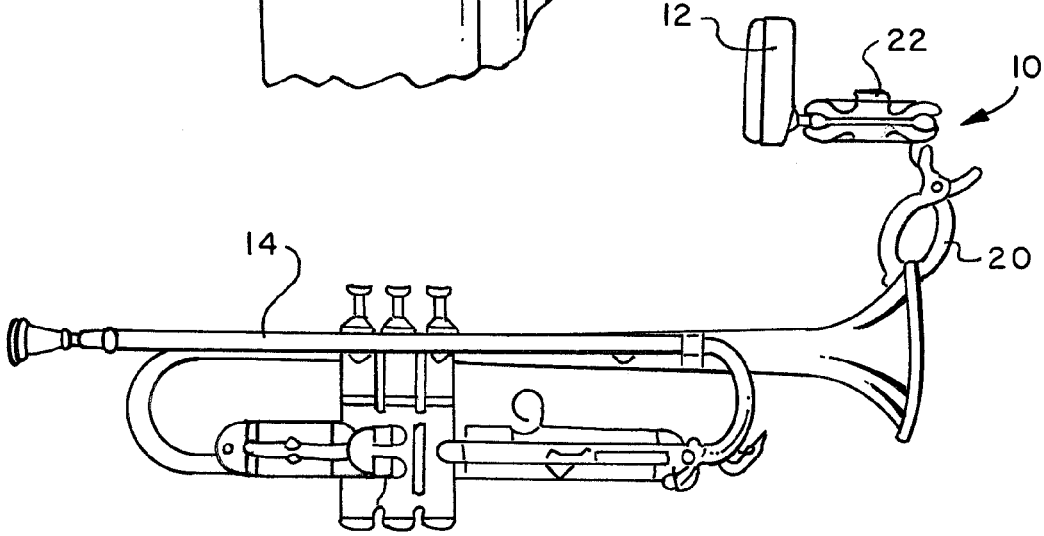
FIG. 7 is a side view of the invention in use on a second musical instrument.

Once attached, the dual swiveling link ends permit the tuner to be quickly swung to the desired angle, then locked by operation of the knurled knob. Greatest advantage is obtained by providing swiveling connections at both ends of the link, as shown, however a more economical construction might result from eliminating one of the swiveling connections with an accompanying decrease in usability. The slots in the curved surfaces permit exceptional stability of the connection and resistance to creeping changes in the swivel connections, however, the mount is readily used without engaging slots at both ends, as shown in FIG. 7, where the tuner end does not use a slot but the clamp end does.

The illustrated embodiment of the invention includes both the link and the clamp described. One skilled in the art will recognize that the link can be used with a different type of clamp to a lesser advantage, and conversely the clamp could be connected to the tuner in a different manner, yet many of the benefits of the invention would still be gained.

While the invention has been illustrated and described as embodied in a tuner mount, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

Whereas, the present invention has been described with respect to a specific embodiment thereof, it will be understood that various changes and modifications will be suggested to one skilled in the art and it is intended to encompass such changes and modifications as fall within the scope of the appended claims.

The invention claimed is:

1. A universal mount for acoustically coupling a musical instrument tuner to an instrument, comprising:

a tuner sphere with a center point fixed to the tuner;

a link adapted and arranged to have selectable loose and fixed states, with the link including complementary first and second clamping halves joined by a compression element;

with an opposing pair of curved surfaces on a tuner end of the link, one of said pair of curved surfaces being on a tuner end of the first clamping half and the other curved surface being on a tuner end of the second clamping half, the curved surfaces at the tuner end disposed to grip the tuner sphere under compression imposed by the compression element when the link is in the fixed state and to release the tuner sphere for relative swiveling motion about the center point of the tuner sphere when the link is in the loose state;

a clamp connected to a clamp end of the link for acoustically coupling the link and tuner to the musical instrument;

with the compression element being a threaded fastener extending through the clamping halves; and with the threaded fastener including a shaft with an abutment surface at one end adjacent one clamping half of the link, a male-threaded central section, a female-threaded nut engaged with the central section of the shaft and adjacent the other clamping half of the link, the nut fixed against rotation relative the other clamping half, and an E-clip engaged with the other end of the shaft, such that the E-Clip prevents the shaft and nut from being be completely disengaged, and the fixed state of the link is selected by turning the shaft relative the nut in one direction to bring the abutment surface and nut into contact with their respective clamping halves, and the loose state of the link is selected by turning the shaft relative the nut in the other direction.

2. The mount of claim 1 with the compression element being hand-operable.

3. The mount of claim 2 with the compression element being hand-operable by way of a knurled knob.

4. The mount of claim 1 with the compression element being centrally located between said tuner and clamp ends of the link.

5. The mount of claim 1 with a first slot in the tuner end first clamping half curved surface and a second slot in the tuner end second clamping half curved surface, the first and second slots permitting lateral support of the tuner post when the tuner post is swiveled into engagement with any of the first or second slots.

6. The mount of claim 5 with opposed half slots in the tuner end clamping half curved surfaces cooperating to form third and fourth slots, the third and fourth slots permitting lateral support of the tuner post when the tuner post is swiveled into engagement with any of the third or fourth slots.

7. A universal mount for acoustically coupling a musical instrument tuner to an instrument, comprising:

a link connected to the tuner at a tuner end of the link;

a clamp sphere with a center point fixed to a clamp for acoustically coupling the link and tuner to the musical instrument;

the link adapted and arranged to have selectable loose and fixed states, with the link including complementary first and second clamping halves joined by a compression element; and with an opposing pair of curved surfaces on a clamp end of the link, one of said pair of curved surfaces being on a clamp end of the first clamping half and the other curved surface being on a clamp end of the second clamping half, the curved surfaces at the clamp end disposed to grip the clamp sphere under compression imposed by the compression element when the link is in the fixed state and to release the clamp sphere for relative swiveling motion about the center point of the clamp sphere when the link is in the loose state.

8. The mount of claim 7 with a clamp post extending from the clamp, and the clamp sphere connected to an end of the clamp post remote from the clamp.

9. The mount of claim 8 with the clamp post extending from an actuating arm of the clamp.

10. The mount of claim 7 with the compression element being a threaded fastener extending through the clamping halves.

11. The mount of claim 10 with the threaded fastener including a shaft with an abutment surface at one end adjacent one clamping half of the link, a male-threaded central section, a female-threaded nut engaged with the central section of the shaft and adjacent the other clamping half of the link, the nut fixed against rotation relative the other clamping half, and an E-clip engaged with the other end of the shaft, such that the E-Clip prevents the shaft and nut from being be completely disengaged, and the fixed state of the link is selected by turning the shaft relative the nut in one direction to bring the abutment surface and nut into contact with their respective clamping halves, and the loose state of the link is selected by turning the shaft relative the nut in the other direction.

12. The mount of claim 11 with the compression element being hand-operable.

13. The mount of claim 12 with the compression element being hand-operable by way of a knurled knob.

14. The mount of claim 7 with the compression element being centrally located between said tuner and clamp ends of the link.

15. The mount of claim 8 with a first slot in the clamp end first clamping half curved surface and a second slot in the clamp end second clamping half curved surface, the first and second slots permitting lateral support of the clamp post when the clamp post is swiveled into engagement with any of the first or second slots.

16. The mount of claim 5 with opposed half slots in the clamp end clamping half curved surfaces cooperating to form third and fourth slots, the third and fourth slots permitting lateral support of the clamp post when the clamp post is swiveled into engagement with any of the third or fourth slots.

17. A universal mount for acoustically coupling a musical instrument tuner to an instrument, comprising:

a tuner sphere with a center point fixed to the tuner;

a link adapted and arranged to have selectable loose and fixed states, with the link including complementary first and second clamping halves joined by a compression element;

with an opposing pair of curved surfaces on a tuner end of the link, one of said pair of curved surfaces being on a tuner end of the first clamping half and the other curved surface being on a tuner end of the second clamping half, the curved surfaces at the tuner end disposed to grip the tuner sphere under compression imposed by the compression element when the link is in the fixed state and to release the tuner sphere for relative swiveling motion about the center point of the tuner sphere when the link is in the loose state;

a clamp connected to a clamp end of the link for acoustically coupling the link and tuner to the musical instrument; and the clamp connected to the clamp end of the link by way of a clamp sphere with a center point fixed to the clamp; and with an opposing pair of curved surfaces on the clamp end of the link, one of said pair of curved surfaces being on a clamp end of the first clamping half and the other curved surface being on a clamp end of the second clamping half, the curved surfaces disposed to grip the clamp sphere under compression imposed by the compression element when the link is in the fixed state and to release the clamp sphere for relative swiveling motion about the center point of the clamp sphere when the link is in the loose state.

18. The mount of claim 17 with a tuner post extending from the tuner, and the tuner sphere connected to an end of the tuner post remote from the tuner, and with a clamp post extending from the clamp, and the clamp sphere connected to an end of the clamp post remote from the clamp.

19. The mount of claim 18 with the tuner post extending from a lower back surface of the tuner, and with the clamp post extending from an actuating arm of the clamp.

20. The mount of claim 17 with the compression element being a threaded fastener extending through the clamping halves.

21. The mount of claim 20 with the threaded fastener including a shaft with an abutment surface at one end adjacent one clamping half of the link, a male-threaded central section, a female-threaded nut engaged with the central section of the shaft and adjacent the other clamping half of the link, the nut fixed against rotation relative the other clamping half, and an E-clip engaged with the other end of the shaft, such that the E-Clip prevents the shaft and nut from being be completely disengaged, and the fixed state of the link is selected by turning the shaft relative the nut in one direction to bring the abutment surface and nut into contact with their respective clamping halves, and the loose state of the link is selected by turning the shaft relative the nut in the other direction.

22. The mount of claim 21 with the compression element being hand-operable.

23. The mount of claim 22 with the compression element being hand-operable by way of a knurled knob.

24. The mount of claim 17 with the compression element being centrally located between said tuner and clamp ends of the link.

25. The mount of claim 18 with a first slot in the tuner end first clamping half curved surface and a second slot in the tuner end second clamping half curved surface, the first and second slots at the tuner end permitting lateral support of the tuner post when the tuner post is swiveled into engagement with any of the first or second slots at the tuner end, and with a first slot in the clamp end first clamping half curved surface and a second slot in the clamp end second clamping half curved surface, the first and second slots at the clamp end permitting lateral support of the clamp post when the clamp post is swiveled into engagement with any of the first or second slots at the clamp end.

26. The mount of claim 25 with opposed half slots in the tuner end clamping half curved surfaces cooperating to form third and fourth slots at the tuner end, the third and fourth slots at the tuner end permitting lateral support of the tuner post when the tuner post is swiveled into engagement with any of the third or fourth slots at the tuner end, and with opposed half slots in the clamp end clamping half curved surfaces cooperating to form third and fourth slots at the clamp end, the third and fourth slots at the clamp end permitting lateral support of the clamp post when the clamp post is swiveled into engagement with any of the third or fourth slots at the clamp end.

27. A universal mount for acoustically coupling a musical instrument tuner to an instrument, comprising:

a tuner sphere with a center point fixed to the tuner;

a clamp sphere with a center point fixed to a clamp, the clamp being for acoustically coupling the tuner to the musical instrument;

a link adapted and arranged to have selectable loose and fixed states, with the link including complementary first and second clamping halves joined by a compression element;

with an opposing pair of curved surfaces on a tuner end of the link, one of said pair of curved surfaces being on a tuner end of the first clamping half and the other curved surface being on a tuner end of the second clamping half, and with an opposing pair of curved surfaces on the clamp end of the link, one of said pair of curved surfaces being on a clamp end of the first clamping half and the other curved surface being on a clamp end of the second clamping half;

the curved surfaces at the tuner end disposed to grip the tuner sphere under compression imposed by the compression element when the link is in the fixed state and to release the tuner sphere for relative swiveling motion about the center point of the tuner sphere when the link is in the loose state;

the curved surfaces at the clamp end disposed to grip the clamp sphere under compression imposed by the compression element when the link is in the fixed state and to release the clamp sphere for relative swiveling motion about the center point of the clamp sphere when the link is in the loose state;

with a tuner post extending from the tuner, and the tuner sphere connected to an end of the tuner post remote from the tuner, and with a clamp post extending from the clamp, and the clamp sphere connected to an end of the clamp post remote from the clamp;

with the tuner post extending from a lower back surface of the tuner, and with the clamp post extending from an actuating arm of the clamp;

with the compression element being a threaded fastener extending through the clamping halves;

with the threaded fastener including a shaft with an abutment surface at one end adjacent one clamping half of the link, a male-threaded central section, a female-threaded nut engaged with the central section of the shaft and adjacent the other clamping half of the link, the nut fixed against rotation relative the other clamping half, and an E-clip engaged with the other end of the shaft, such that the E-Clip prevents the shaft and nut from being be completely disengaged, and the fixed state of the link is selected by turning the shaft relative the nut in one direction to bring the abutment surface and nut into contact with their respective clamping halves, and the loose state of the link is selected by turning the shaft relative the nut in the other direction;

with the compression element being hand-operable by way of a knurled knob;

with the compression element being centrally located between said tuner and clamp ends of the link;

with a first slot in the tuner end first clamping half curved surface and a second slot in the tuner end second clamping half curved surface, the first and second slots at the tuner end permitting lateral support of the tuner post when the tuner post is swiveled into engagement with any of the first or second slots at the tuner end, and with a first slot in the clamp end first clamping half curved surface and a second slot in the clamp end second clamping half curved surface, the first and second slots at the clamp end permitting lateral support of the clamp post when the clamp post is swiveled into engagement with any of the first or second slots at the clamp end; and with opposed half slots in the tuner end clamping half curved surfaces cooperating to form third and fourth slots at the tuner end, the third and fourth slots at the tuner end permitting lateral support of the tuner post when the tuner post is swiveled into engagement with any of the third or fourth slots at the tuner end, and with opposed half slots in the clamp end clamping half curved surfaces cooperating to form third and fourth slots at the clamp end, the third and fourth slots at the clamp end permitting lateral support of the clamp post when the clamp post is swiveled into engagement with any of the third or fourth slots at the clamp end.

28. A universal mount for acoustically coupling a musical instrument tuner to an instrument, comprising:

a clamp connected to the tuner for acoustically coupling the tuner to the musical instrument;

the clamp having a pair of hinged, opposed clamping arms joined by a hinge pin;

the clamp being urged to a closed state by a spring;

the clamp having a pair of opposed actuating arms, each of the actuating arms extending from a different one of the clamping arms at the hinge pin, such that relative motion of actuating arms towards each other moves the clamp to an opened state against the urging of the spring, and release of the actuating arms causes the clamping arms to clamp on to a part of a musical instrument placed between the clamping arms;

and each of the clamping arms including a curved intermediate surface and a planar end surface, the planar end surfaces being parallel and abutting each other when the clamp is in the closed state, and the curved intermediate surfaces being oppositely curved, such that the curved intermediate surfaces define an open space between the curved intermediate surfaces;

with the curved intermediate surfaces being partially cylindrical; and with the planar end surfaces having semi-circular perimeters.

* * * * *